US009507325B1

(12) United States Patent
Barrie

(10) Patent No.: US 9,507,325 B1
(45) Date of Patent: Nov. 29, 2016

(54) WEARABLE MOBILE DEVICE SYSTEM

(71) Applicant: Ifthikhar Ismail Barrie, Toronto (CA)

(72) Inventor: Ifthikhar Ismail Barrie, Toronto (CA)

( * ) Notice: Subject to any disclaimer, the term of this patent is extended or adjusted under 35 U.S.C. 154(b) by 0 days.

(21) Appl. No.: 14/801,683

(22) Filed: Jul. 16, 2015

(51) Int. Cl.
*G04G 21/02* (2010.01)
*G04B 47/06* (2006.01)

(52) U.S. Cl.
CPC ..... *G04G 21/025* (2013.01); *G04B 47/063* (2013.01)

(58) Field of Classification Search
CPC ..... G04G 17/00; G04G 21/025; G04C 3/00; G04B 47/063; G04B 47/06
USPC ..... 368/282
See application file for complete search history.

(56) References Cited

U.S. PATENT DOCUMENTS 4,444,513 A * 4/1984 Proellochs ..... G04B 37/0427 368/223
5,479,381 A * 12/1995 Goldenberg ..... G04B 19/23 224/175
6,779,917 B1 * 8/2004 Chappuis ..... G04B 37/0083 368/276
8,275,327 B2 9/2012 Yi et al.
8,576,073 B2 * 11/2013 Mooring ..... G06F 1/163 340/407.1
D703,204 S 4/2014 Riddiford et al.
8,773,847 B2 7/2014 Byun et al.
8,985,442 B1 3/2015 Zhou et al.
9,002,420 B2 4/2015 Pattikonda et al.
9,152,129 B2 * 10/2015 Modaragamage ..... A44C 5/24
2007/0279852 A1 * 12/2007 Daniel ..... A44C 5/0007 361/679.03
2009/0069045 A1 3/2009 Cheng
2009/0231960 A1 9/2009 Hutcheson
2010/0146463 A1 6/2010 Cho
2013/0300578 A1 11/2013 Uchida
2014/0045547 A1 2/2014 Singamsetty et al.
2014/0098648 A1 * 4/2014 Breckman ..... G04B 45/00 368/228
2015/0078144 A1 3/2015 Gong
2015/0098309 A1 * 4/2015 Adams ..... G04G 9/0064 368/10

* cited by examiner

*Primary Examiner* — Sean Kayes
(74) *Attorney, Agent, or Firm* — Integrity Patent Group, PLC; Edwin Wold

(57) ABSTRACT

A mobile device that runs its own operating system that attaches to a wristwatch that syncs to a mobile phone via BLUETOOTH® having the capability to notify the user of phone calls, text messages, health information, providing the capability to perform mobile payments for purchases, etc. without having to purchase a separate smart watch. The device may be secured and activated by the user's fingerprint. The watch stick may be attached anywhere along the band of the wearer's wristwatch. The optimal location is the band area of the underside of the wrist (front of the wrist).

9 Claims, 5 Drawing Sheets

WEARABLE MOBILE DEVICE SYSTEM

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of electronic devices suitable for wear and more specifically relates to a wearable mobile device system.

2. Description of Related Art

Individuals in modern society have the advantage of the ready availability of a variety of technological devices. Such electronic devices used for communication may include computers, laptops, smart phones, smartwatches and the like. A smartwatch is a computerized wristwatch with functionality that is enhanced beyond timekeeping. While early models performed basic tasks, such as calculations, translations, and game-playing, modern smartwatches are effectively 'wearable' computers. Many smartwatches run mobile apps, while a smaller number of models run a mobile operating system and function as portable media players, offering playback of FM radio, audio, and video files.

Like other computers, a smartwatch may collect information from internal or external sensors. A smartwatch may control, or retrieve data from, other instruments or computers and some may support wireless technologies. Conventional wristwatch computers may simply serve as a front end for a remote system, as in the case of watches utilizing cellular technology or Wi-Fi. However, conventional smartwatches may be bulky and inconveniently oriented for use. Further, it may desirable that the technology not replace existing watches. A suitable solution is desirable.

Several attempts have been made to solve the above-mentioned problems such as those found in International and U.S. Pat., Pub. and Design Pat. Nos. WO2014161456 to Hongming Jiang; 2013/0300578 to Kaoru Uchida; D703,204 to Martin Riddiford et al.; U.S. Pat. No. 8,985,442 to Tiger T G Zhou et al.; U.S. Pat. No. 9,002,420 to Ram Pattikonda et al.; 2015/0078144 to Renxiao Gong; CN204031248 to Lvyan Ju et al.; 2014/0045547 to Suresh Singamsetty et al.; CN103135440 to Pack Into; U.S. Pat. No. 8,275,327 to Kyung-Hack Yi et al.; 2009/0069045 to Ta-Peng Cheng; U.S. Pat. No. 8,773,847 to Huiseob Byun et al.; WO2005103846 to Jean Michel Baroche; 2009/0231960 to Gavin James Hutcheson; 2010/0146463 to Shi-yun Cho et al.; and U.S. Pat. No. 9,037,098 to Barry Nadler et al. This art is representative of electronic devices suitable for wear. However, none of the above inventions and patents, taken either singly or in combination, is seen to describe the invention as claimed.

Preferably, a wearable mobile device system should provide users with an alternative to conventional smartwatches and, yet would operate reliably and be manufactured at a modest expense. Thus, a need exists for a reliable wearable mobile device system to avoid the above-mentioned problems.

BRIEF SUMMARY OF THE INVENTION

In view of the foregoing disadvantages inherent in the known electronic devices suitable for wear art, the present invention provides a novel wearable mobile device system.

The general purpose of the present invention, which will be described subsequently in greater detail is to provide an efficient communication means that may be retrofit to an existing watch.

The present invention comprises a mobile device that runs its own operating system that attaches to a wristwatch which syncs to a mobile phone via BLUETOOTH® having the capability to notify the user of phone calls, text messages, health information, having the capability to perform mobile payments for purchases, and the like, without having to purchase a separate smart watch. The device may be secured and activated by the users fingerprint. The watchstick may be attached anywhere along the band of the wearer's wristwatch. The optimal location for attachment is the band area of the underside of the wrist (front of the wrist). The preferred positioning allows for ease of use and comfort during such use.

A wearable mobile device system is disclosed herein, in a preferred embodiment, comprising: a wearable mobile device assembly including a wrist-watch adaptable mobile device having a body (with a face plate, a back plate; the plates defining an inner volume when coupled), a display screen, a powerer, a cpu capable of running an operating system, a memory storage unit, a wireless transmitter and a receiver unit, at least one physiological sensor, a microchip, and an attacher; wherein the wearable mobile device assembly comprises the wearable mobile device system.

The wrist-watch adaptable mobile device and the attacher comprise in functional combination the wearable mobile device assembly. The body comprising the face plate, and the back plate are coupleable to form the inner volume (as a protective shell structure). The display screen is fixedly mounted to a front surface of the face plate for viewing; wherein the display screen permits the user-wearer to use an incorporated touchscreen to react to and control what is displayed.

The powerer, the cpu, the memory storage unit, the microchip and the wireless transmitter and the receiver unit are fixedly mounted inside the inner volume of the body, where the mentioned components are enclosed to prevent damage from occurring. The wireless transmitter and receiver unit comprises GPS capability. The wrist-watch adaptable mobile device also comprises wireless technology capable of exchanging data over short distances using short-wavelength UHF radio waves in the ISM band from 2.4 to 2.485 GHz, for functional use with a BLUETOOTH® device. The powerer (at least one battery) powers the wrist-watch adaptable mobile device for use. The cpu and the microchip function in combination to operate the operating system of the wrist-watch adaptable mobile device; wherein the memory storage unit is useful for storing digital data pertinent to operation of the wrist-watch adaptable mobile device.

The wrist-watch adaptable mobile device is activatable via at least one fingerprint authentication via means known by those skilled in such art. The at least one physiological sensor is mounted to the body wrist-watch adaptable mobile device and is structured and arranged to detect at least one physiological sign of a user-wearer via touch contact with the skin of the user-wearer. The wrist-watch adaptable mobile device, when worn, is relationally parallel to the existing wrist-watch (but occupying a location on the opposite side of the wrist fastenably held below the band); the attacher comprises at least two folding clips in certain embodiments and other securing/fastening means may be used in alternate embodiments. Clips may be of disparate lengths and may be of one-piece construction or multiple-piece design. The attacher may allow the wrist-watch adaptable mobile device to straddle the existing wristwatch band or to be in a position located lower than the wristband when hand is tilted upwardly (located distally from the hand rather than proximally). The attacher is structured and arranged to removably-attach the wrist-watch adaptable mobile device to an existing wrist-watch of the user-wearer. As normally coupled, relationally-speaking, the touchscreen is oriented in a direction which opposes a face-direction of the existing wrist-watch. This positioning is a feature that allows for ease of use and comfort when interaction with the device occurs since it is more 'normal' and stable.

The wearable mobile device system is structured and arranged to removably-couple to the existing wrist-watch of the user-wearer via the attacher; the wrist-watch adaptable mobile device mounting adjacent to a wrist of the user-wearer on a palm-side of the wrist of the user-wearer; the wrist-watch adaptable mobile device able to monitor the at least one physiological sign of the user-wearer, and to display the at least one physiological sign of the user-wearer in addition to a myriad of real-time interactive applications including texting, performing mobile payments for purchases, making and receiving phone calls, taking pictures via a camera, (and others). In this way the present invention is useful to provide health and informational awareness of the user-wearer as well as offer a host of communication means.

A method of using a wearable mobile device system is also disclosed herein comprising at least the steps of: attaching, activating, sensing, displaying, and interacting. The real-time interactive applications are selected from the group consisting of texting, performing mobile payments for purchases, phoning, and picture taking. Other interactive applications may also be used to promote efficient communication and data transmission and retrieval.

The present invention holds significant improvements and serves as a wearable mobile device system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, wearable mobile device system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to an electronic device suitable for wear and more particularly to a wearable mobile device system (entitled Watchstick™) as used to improve the efficiency of communication.

Generally speaking, the wearable mobile device system of the present invention provides a retro-fit electronic device and coupling means (attacher) for use with existing watches which may use NFC technology allowing the user to send and receive documents. The device preferably comprises at least 8 GB storage capacity and in certain embodiments may comprise a mini virtual keyboard. The instant invention may be used with or without BLUETOOTH® technology. Battery charging may be accomplished via solar power, or by a traditional charger. BLUETOOTH® technology synchronizes the device to a mobile phone allowing the watchstick to interact with selected applications.

Preferred embodiments may comprise a finger print reader requiring fingerprint authentication as a security requirement to unlock the watchstick to verify authority for use. Certain embodiments may also comprise a lock button. Mobile payments may be paid via the watchstick which may process payments either through Google pay or apple pay or the like thus allowing the owner to make purchases in a convenient fashion. Further, microphone and earphone equipped units allow the user to listen and talk into the device. Voice to text capability may be used with the present invention to convert voice to text for messaging, email, and social networking updates.

As designed, a lock to cell phone/clone cell phone number to watchstick may be used with for example a 3G radio chip that activates when watchstick detects there's no longer a BLUETOOTH® connection to the mobile phone. This will enable the user to make and receive calls. Preferred embodiments may also comprise camera functionality. The camera may comprise an adjustable lens that can extend and rotate so the user can position it for the best possible view. Further, sensors may be located in the underside of the device/clip touching the skin; the sensors used to measure bio/health data in real time. Wrist flex technology gives the present invention the capability to allow the user to navigate the screen and within applications of the watchstick using wrist flexing movements. Relative positioning for the camera, fingerprint reader and the like may vary between embodiments.

Figure 3:
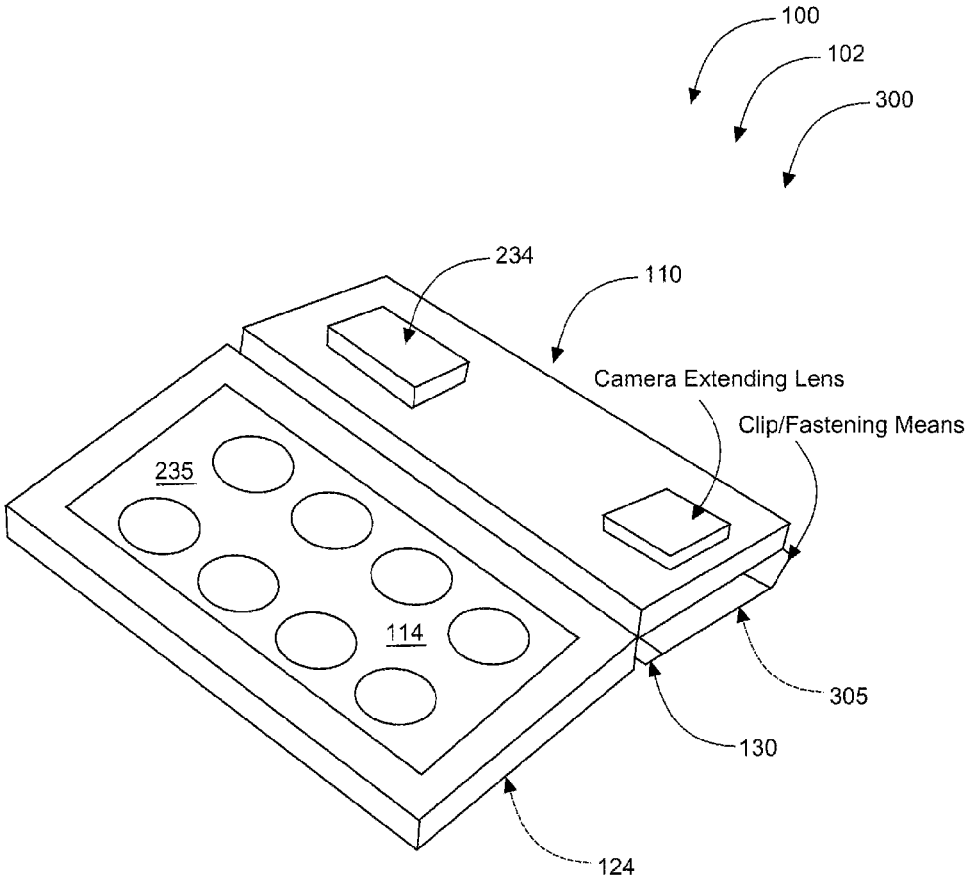
FIG. 3 is a perspective view illustrating the wearable mobile device assembly according to an embodiment of the present invention of FIGS. 1A-2B.

Referring more specifically to the drawings by numerals of reference there is shown in FIGS. 1A-4, various views of wearable mobile device system 100 comprising: wearable mobile device assembly 102 including wrist-watch adaptable mobile device 110 having body 112, display screen 114, at least one powerer 116 (battery or the like), cpu 118 to run an operating system 120, memory storage unit 122, at least one physiological sensor 124, microchip 126, and an attacher 130 (attachment means). As such, wearable mobile device assembly 102 comprises wearable mobile device system 100. Further, wrist-watch adaptable mobile device 110 and attacher 130 comprise in functional combination wearable mobile device assembly 102. FIG. 1B shows first embodiment 200 of wearable mobile device system 100 in an in-use condition 150. FIGS. 1C and 3 show second embodiment 300 of wearable mobile device system 100.

Figure 4:
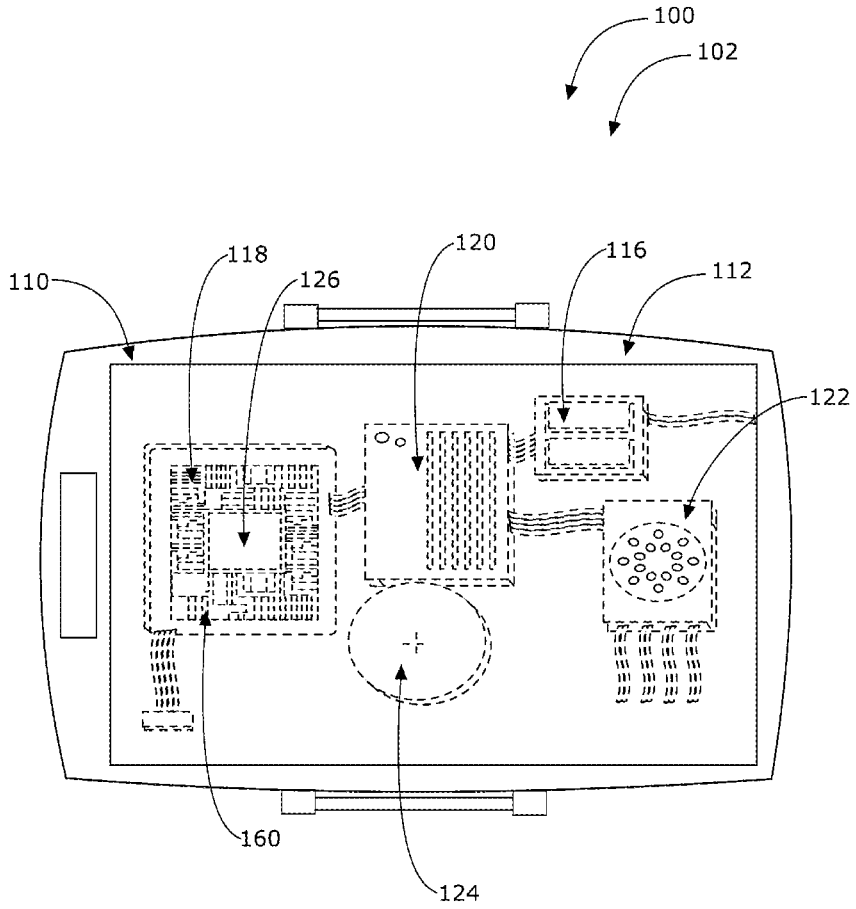
FIG. 4 is a perspective view illustrating various internal components of the wearable mobile device assembly according to an alternate embodiment of the present invention of FIGS. 1A-3.

Referring now to body 112 in greater detail; body 112 comprises face plate 210, and back plate 215; wherein face plate 210 and back plate 215 are coupleable to form inner volume 220. Body 112 may comprise a 3D rectangular shape. Other shapes may be used. Display screen 114 is fixedly mounted to a front surface of face plate 210 for viewing displayed digital data 160. Powerer 116, cpu 118, memory storage unit 122, and microchip 126 are fixedly mounted inside inner volume 220 of body 112, as shown in FIG. 4. Powerer 116 powers wrist-watch adaptable mobile device 110 for use; wherein cpu 118 and microchip 126 function in combination to operate operating system 120 of wrist-watch adaptable mobile device 110. Memory storage unit 122 is useful for storing digital data 160 pertinent to operation of wrist-watch adaptable mobile device 110. Wrist-watch adaptable mobile device 110 is able to remotely communicate with external devices via the internet or phone communication systems.

At least least one physiological sensor 124 may be mounted to body 112 of wrist-watch adaptable mobile device 110 and may be structured and arranged to detect at least one physiological sign of a user-wearer 140 via 'known in the art' sensing means. It should be appreciated that physiological sign(s) may include, but are not limited to, pulse monitoring, heart rate, body temperature, respiratory rate monitoring and the like. Further, at least one physiological sensor is able to track movement of user 140. In such a manner, footsteps and sleep movements may be tracked and displayed to user 140.

Those with ordinary skill in the art will now appreciate that upon reading this specification and by their understanding the art of sensing and communication of related data as described herein, methods of use of sensors and communication means will be understood by those knowledgeable in such art.

Attacher 130 is structured and arranged to removably-attach wrist-watch adaptable mobile device 110 to an existing wrist-watch 106 of user-wearer 140, as shown. Wearable mobile device system 100 is structured and arranged to removably-couple to the existing wrist-watch 106 of user-wearer 140 via attacher 130; wrist-watch adaptable mobile device 110 mounting adjacent to wrist 105 of user-wearer 140 on a palm-side of wrist 105 of user-wearer 140. Wrist-watch adaptable mobile device 110 is further able to monitor the at least one physiological sign of user-wearer 140, as worn (shown in FIG. 1B), and to display the at least one physiological sign of user-wearer 140 in addition to a myriad of real-time interactive applications useful to provide health and informational awareness of user-wearer 140. Upon reading this specification, it should be appreciated that, under appropriate circumstances, considering such issues as user preferences, design preference, structural requirements, marketing preferences, cost, available materials, technological advances, etc., other attachment and fastening means and arrangements such as, for example, one-piece clips, two-piece clips, multiple-piece clips, bands, jointed-bands, various clipping-fastener-assembl(ies), etc., may be sufficient.

In preferred embodiments of first embodiment 200 wrist-watch adaptable mobile device 110 may comprise wireless transmitter and receiver unit 230; wireless transmitter and receiver unit 230 may comprise GPS 232. Wrist-watch adaptable mobile device 110, as designed, may comprise wireless technology capable of exchanging digital data 160 over short distances using short-wavelength UHF radio waves in an ISM band from 2.4 to 2.485 GHz such as used in BLUETOOTH® technology. To promote enhanced security wrist-watch adaptable mobile device 110 is activatable via at least one fingerprint authentication 234. In this way user-wearer 140 may effectively restrict use of the present invention. Those with ordinary skill in the art will now appreciate that upon reading this specification and by their understanding the art of use of fingerprint reading as a means for securing an electronic device from unauthorized use as described herein, methods of fingerprint authentication will be understood by those knowledgeable in such art.

Figure 1A:
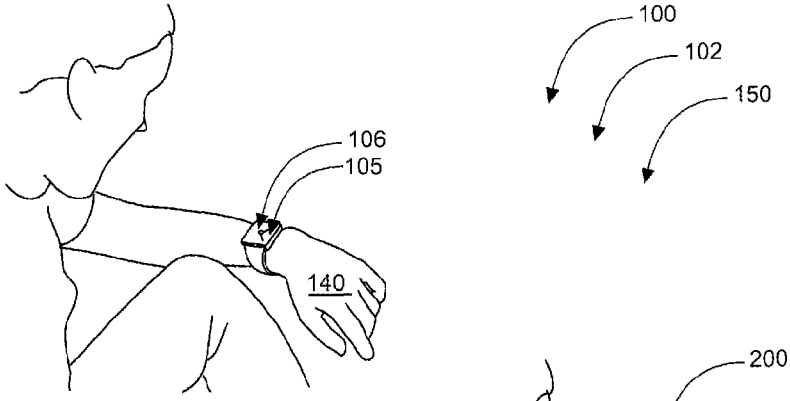
FIG. 1A shows a perspective view illustrating a user wearing a watch in conjunction with an attached wearable mobile device system ready for an 'in-use' condition according to an embodiment of the present invention.
Figure 1B:
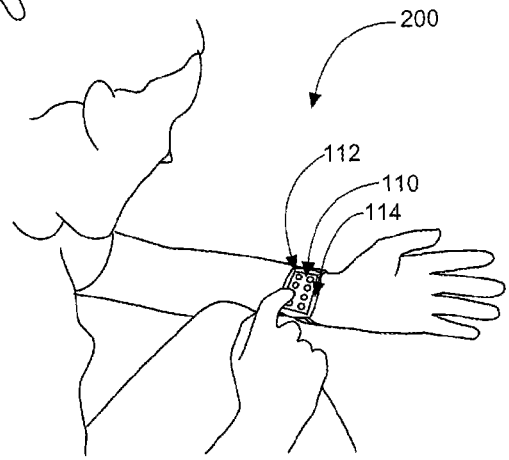
FIG. 1B shows a perspective view illustrating the user wearing the watch 'as coupled' with the wearable mobile device system in an 'in-use' condition according to a first embodiment of the present invention.
Figure 1C:
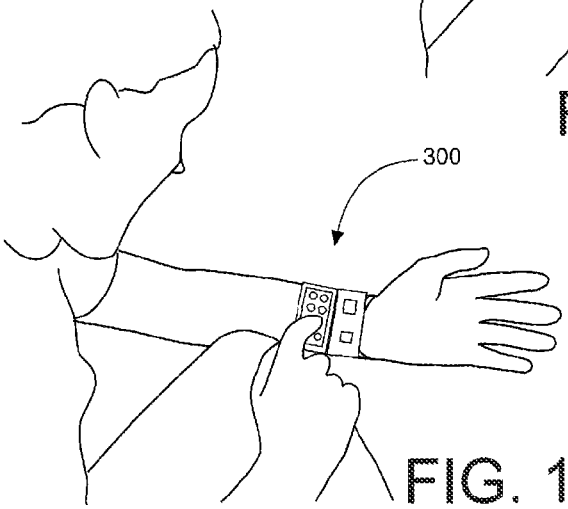
FIG. 1C shows a perspective view illustrating the user wearing the watch 'as coupled' with the wearable mobile device system in an 'in-use' condition according to a second embodiment of the present invention.
Figure 2A:
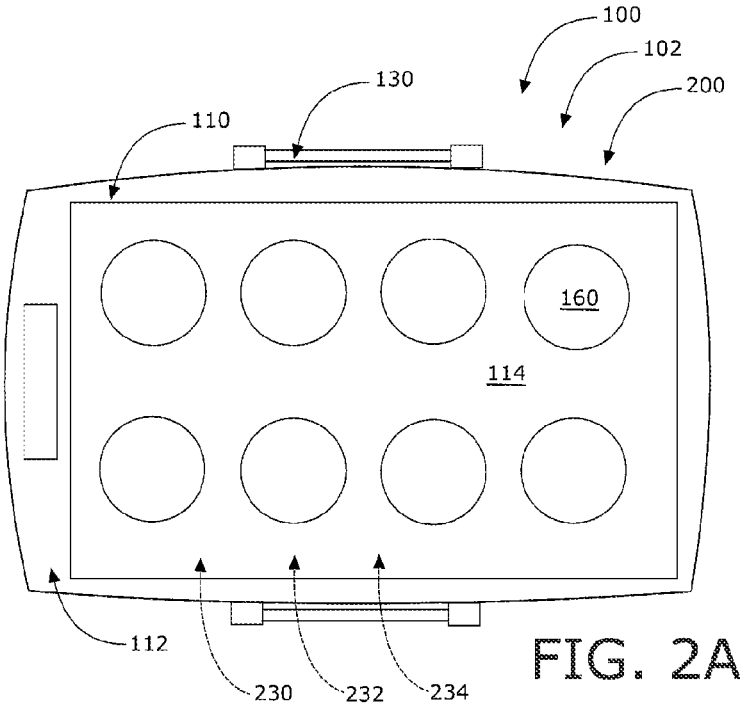
FIG. 2A is a top perspective view illustrating a wearable mobile device assembly of the wearable mobile device system according to an embodiment of the present invention of FIG. 1B.
Figure 2B:
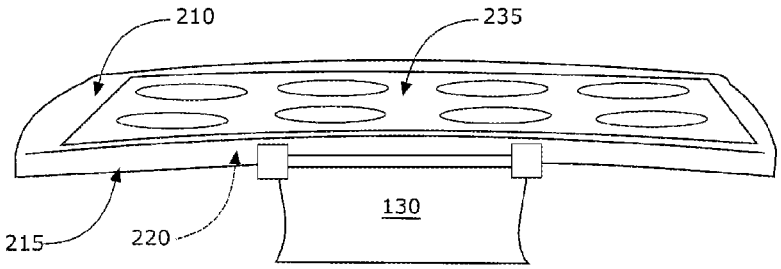
FIG. 2B is a side perspective view illustrating the wearable mobile device assembly of the wearable mobile device system according to an embodiment of the present invention of FIGS. 1A-2A.

Wrist-watch adaptable mobile device 110, when worn, is relationally parallel to the existing wrist-watch 106 (as alluded to in FIGS. 1A and 1B); attacher 130 may comprise in certain embodiments at least two folding clips 305 (in second embodiment 300 shown in FIGS. 1C and 3). Various equivalent means for providing fastening may be employed. Attacher 130 may comprise a clipping-fastener-assembly. Display screen 114 permits user-wearer 140 to use an incorporated touchscreen 235 to react to what is displayed and to control how it is displayed, as shown in FIG. 1B. Touchscreen 235 is oriented in a direction which opposes a face-direction of the existing wrist-watch 106, as alluded to in FIGS. 1A and 1B.

One of the real-time interactive applications of wearable mobile device system 100 may comprise texting; another of the real-time interactive applications may comprise performing mobile payments for purchases; and yet another making and receiving phone calls. Yet another of the real-time interactive applications may comprise taking pictures via a camera; camera comprising an adjustable lens which can extend and rotate for achieving optimum positioning for picture taking. Wrist-watch adaptable mobile device 110 may be in communication with a microphone and/or with an earphone. For use in health monitoring at least one physiological sensor 124 is positioned adjacent skin of the user-wearer 140 during wear; at least one physiological sensor 124 in communication with cpu 118 and display screen 114 to output digital data 160. In this way user-wearer 140 is able to track his/her health/vital signs in real time. This feature may be handy for use during exercising or the like.

Figure 5:
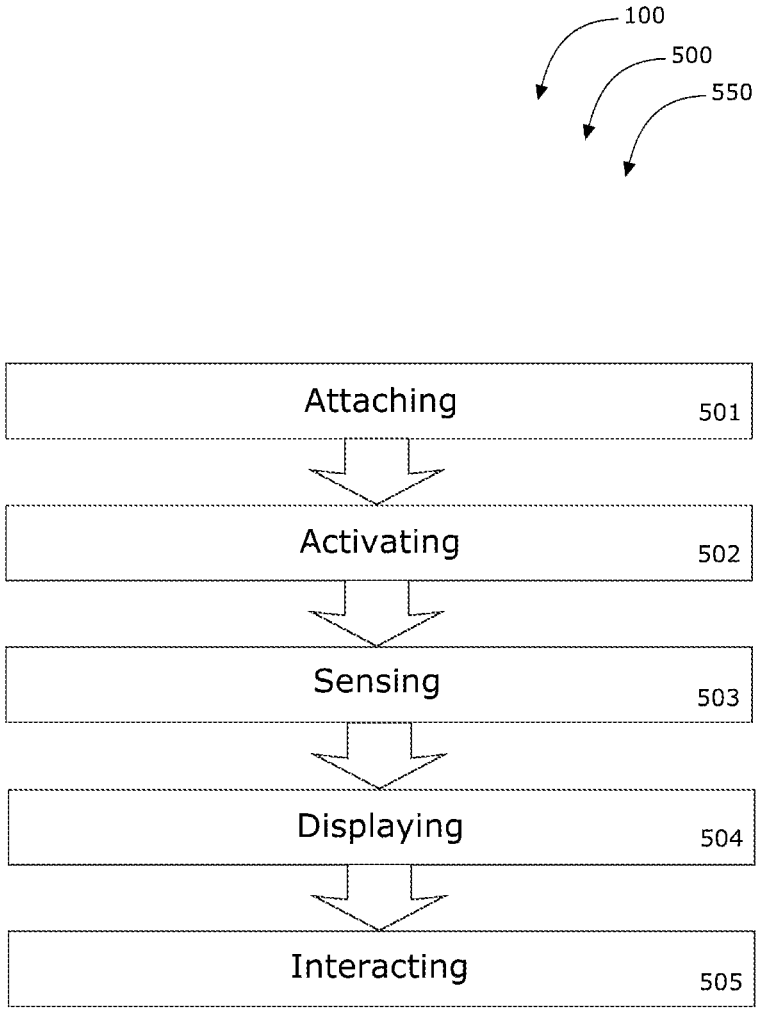
FIG. 5 is a flowchart illustrating a method of use for the wearable mobile device system according to an embodiment of the present invention of FIGS. 1A-4.

Referring now to FIG. 5, a flowchart 550 is shown illustrating a method of use 500 for wearable mobile device system 100 according to an embodiment of the present invention of FIGS. 1A-4.

A method of using (method of use 500) wearable mobile device system 100 comprises the steps of: step one 501 removably coupling (attaching) wrist-watch adaptable mobile device 110 to a watch band; wrist-watch adaptable mobile device 110 preferably oriented on a palm-side of wrist 105 of user-wearer 140, step two 502 activating device and manipulating display screen 114 via touch (on embodiments with touchscreen 235 capability), and step three 503 sensing and using real-time interactive applications. The method 500 may further comprise the step four 504 of monitoring (and displaying) health via physiological sensor (s) 124. Step five 505 may comprise interacting; the real-time interactive applications are selected from the group consisting of (at least) texting, performing mobile payments for purchases, phoning, and picture taking, as previously mentioned.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A wearable mobile device system comprising:
a wearable mobile device assembly including
a wrist-watch adaptable mobile device having
a body,
a display screen,
a powerer,
a CPU to run an operating system,
a memory storage unit,
at least one physiological sensor, and
a microchip; and
an attacher;
wherein said body comprises a face plate and a back plate;
wherein said face plate and said back plate are coupleable to form an inner volume;
wherein said display screen is fixedly mounted to a front surface of said face plate for viewing;
wherein said powerer, said CPU, said memory storage unit, and said microchip are fixedly mounted inside said inner volume of said body;
wherein said powerer powers said wrist-watch adaptable mobile device for use;
wherein said CPU and said microchip function in combination to operate said operating system of said wrist-watch adaptable mobile device when powered;
wherein said memory storage unit is useful for storing digital data pertinent to operation of said wrist-watch adaptable mobile device;
wherein said at least one physiological sensor is mountable to said body wristwatch adaptable mobile device and is structured and arranged to detect at least one physiological sign of a user-wearer;
wherein said attacher is structured and arranged to removably-attach said wristwatch adaptable mobile device to an existing wrist-watch of said user-wearer;
wherein said wearable mobile device system is structured and arranged to removably-couple to said existing wrist-watch of said user-wearer via said attacher, said wrist-watch adaptable mobile device mounting adjacent to a wrist of said user-wearer on a palm-side of said wrist of said user-wearer, said wrist-watch adaptable mobile device able to monitor said at least one physiological sign of said user-wearer, and to display said at least one physiological sign of said user-wearer in addition to being able to perform real-time interactive applications useful to provide health and informational awareness of said user-wearer;
wherein said wrist-watch adaptable mobile device comprises a wireless transmitter and a receiver unit;
wherein said wireless transmitter and receiver unit comprises GPS; and
wherein said wrist-watch adaptable mobile device is activatable via at least one fingerprint authentication.

2. The wearable mobile device system of claim 1, wherein said wrist-watch adaptable mobile device, when worn, is relationally parallel to said existing wrist-watch, said attacher comprising at least two folding clips.

3. The wearable mobile device system of claim 2, wherein said display screen permits said user-wearer to use an incorporated touchscreen to react to what is displayed and to control how said digital data is displayed.

4. The wearable mobile device system of claim 3, wherein said touchscreen is oriented in a direction which opposes a face-direction of said existing wrist-watch.

5. The wearable mobile device system of claim 4, wherein one of said real-time interactive applications comprises wirelessly exchanging of messages drafted using text inputs.

6. The wearable mobile device system of claim 4, wherein another of said real-time interactive applications comprises performing mobile payments for purchases.

7. The wearable mobile device system of claim 4, wherein another of said real-time interactive applications comprises making and receiving phone calls.

8. The wearable mobile device system of claim 4, wherein yet another of said real-time interactive applications comprises taking pictures via a camera, said camera comprising an adjustable lens which can extend and rotate for achieving optimum positioning for picture taking.

9. A wearable mobile device system comprising:
a wearable mobile device assembly including
a wrist-watch adaptable mobile device having
a body having
a face plate,
a back plate, and
an inner volume,
a display screen,
a powerer,
a CPU to run an operating system,
a memory storage unit, a wireless transmitter and a receiver unit,
at least one physiological sensor,
a camera,
a fingerprint reader, and
a microchip; and
an attacher;

wherein said wearable mobile device system comprises said wearable mobile device assembly;

wherein said wearable mobile device assembly comprises in functional combination said wrist-watch adaptable mobile device and said attacher;

wherein said body comprises said face plate, and said back plate are coupleable to form said inner volume;

wherein said display screen is fixedly mounted to a front surface of said face plate for viewing;

wherein said display screen permits said user-wearer to use an incorporated touchscreen to react to and control what is displayed;

wherein said powerer, said CPU, said memory storage unit, said microchip and said wireless transmitter and said receiver unit are fixedly mounted inside said inner volume of said body;

wherein said wireless transmitter and receiver unit comprises GPS capability;

wherein said wrist-watch adaptable mobile device comprises wireless technology capable of exchanging data over short distances using short-wavelength UHF radio waves in the ISM band from 2.4 to 2.485 GHz;

wherein said powerer powers said wrist-watch adaptable mobile device for use;

wherein said CPU and said microchip function in combination to operate said operating system of said wrist-watch adaptable mobile device;

wherein said memory storage unit is useful for storing digital data pertinent to operation of said wrist-watch adaptable mobile device;

wherein said wrist-watch adaptable mobile device is activatable via at least one fingerprint authentication via said fingerprint reader;

wherein said at least one physiological sensor is mountable to said body wristwatch adaptable mobile device and is structured and arranged to detect at least one physiological sign of a user-wearer;

wherein said wrist-watch adaptable mobile device when worn is relationally parallel to said existing wrist-watch, said attacher comprising at least two folding clips;

wherein said attacher is structured and arranged to removably-attach said wristwatch adaptable mobile device to an existing wrist-watch of said user-wearer;

wherein said touchscreen is oriented in a direction which opposes a face-direction of said existing wrist-watch; and wherein said wearable mobile device system is structured and arranged to removably-couple to said existing wrist-watch of said user-wearer via said attacher, said wrist-watch adaptable mobile device mounting adjacent to a wrist of said user-wearer on a palm-side of said wrist of said user-wearer, said wrist-watch adaptable mobile device able to monitor said at least one physiological sign of said user-wearer, and to display said at least one physiological sign of said user-wearer in addition to a myriad of real-time interactive applications including wireless text messaging, performing mobile payments for purchases, making and receiving phone calls, manipulating and taking pictures via said camera, and simultaneously useful to provide health and informational awareness of said user-wearer.

* * * * *